US010551771B2

(12) United States Patent
Uchida et al.

(10) Patent No.: US 10,551,771 B2
(45) Date of Patent: Feb. 4, 2020

(54) ELECTROPHOTOGRAPHIC BELT AND ELECTROPHOTOGRAPHIC IMAGE FORMING APPARATUS

(71) Applicant: CANON KABUSHIKI KAISHA, Tokyo (JP)

(72) Inventors: Kouichi Uchida, Yokohama (JP); Koujirou Izumidate, Chiba (JP); Noriaki Egawa, Komae (JP); Masatsugu Toyonori, Yokohama (JP); Shuji Saito, Suntou-gun (JP); Yasuhiro Matsuo, Kawasaki (JP); Takashi Endo, Kawasaki (JP); Kosuke Saito, Kawasaki (JP)

(73) Assignee: CANON KABUSKIKI KAISHA, Tokyo (JP)

( * ) Notice: Subject to any disclaimer, the term of this patent is extended or adjusted under 35 U.S.C. 154(b) by 0 days.

(21) Appl. No.: 16/377,901

(22) Filed: Apr. 8, 2019

(65) Prior Publication Data

US 2019/0324386 A1 Oct. 24, 2019

(30) Foreign Application Priority Data

Apr. 19, 2018 (JP) ..... 2018-080941
Mar. 18, 2019 (JP) ..... 2019-049878

(51) Int. Cl.
*G03G 15/16* (2006.01)

(52) U.S. Cl.
CPC ..... *G03G 15/162* (2013.01); *G03G 15/161* (2013.01)

(58) Field of Classification Search
CPC ..... G03G 15/161; G03G 15/162; G03G 15/1685; G03G 2215/1623; G03G 2215/1661
See application file for complete search history.

(56) References Cited

U.S. PATENT DOCUMENTS

| | | | |
|---|---|---|---|
| 4,892,800 | A | 1/1990 | Sugata et al. |
| 4,917,939 | A | 4/1990 | Matsuda et al. |
| 5,371,380 | A | 12/1994 | Saito et al. |
| 5,401,330 | A | 3/1995 | Saito et al. |
| 5,563,425 | A | 10/1996 | Saito et al. |
| 5,656,098 | A | 8/1997 | Ishikawa et al. |
| 5,912,465 | A | 6/1999 | Kobayashi et al. |

(Continued)

FOREIGN PATENT DOCUMENTS

JP 2013-044878 3/2013

*Primary Examiner* — Sophia S Chen
(74) *Attorney, Agent, or Firm* — Venable LLP

(57) ABSTRACT

Provided is an electrophotographic belt sustainably excellent in toner removal performance. The electrophotographic belt has an endless shape and has grooves on an outer surface thereof, each of the grooves extending in a circumferential direction and being in non-parallel with the circumferential direction, and the outer surface is composed only of a first region in which the number of the grooves in a direction orthogonal to the circumferential direction is "n" and a second region in which the number of the grooves in the direction orthogonal to the circumferential direction is larger than the "n", the first region and the second region being arranged alternately in the circumferential direction, and the "n" being an integer of 1 or more.

15 Claims, 5 Drawing Sheets

(56) References Cited

U.S. PATENT DOCUMENTS

| | | | | |
|---|---|---|---|---|
| 6,303,215 | B1 * | 10/2001 | Sonobe | G03G 15/1685 428/222 |
| 6,365,308 | B1 | 4/2002 | Kojima et al. | |
| 7,266,329 | B2 | 9/2007 | Matsuo et al. | |
| 8,512,811 | B2 | 8/2013 | Egawa | |
| 8,909,100 | B2 * | 12/2014 | Takahashi | G03G 15/751 399/159 |
| 8,929,784 | B2 | 1/2015 | Takazawa | |
| 9,034,476 | B2 | 5/2015 | Uchida et al. | |
| 9,261,803 | B2 | 2/2016 | Uchida | |
| 2013/0051838 | A1 | 2/2013 | Takazawa | |
| 2014/0197578 | A1 | 7/2014 | Uchida | |
| 2015/0177653 | A1 * | 6/2015 | Seki | G03G 15/162 399/101 |

* cited by examiner

ELECTROPHOTOGRAPHIC BELT AND ELECTROPHOTOGRAPHIC IMAGE FORMING APPARATUS

BACKGROUND

The present disclosure relates to an electrophotographic belt such as a conveyance transfer belt or an intermediate transfer belt to be used for an electrophotographic image forming apparatus such as a copying machine or a printer, and to an electrophotographic image forming apparatus including the electrophotographic belt.

DESCRIPTION OF THE RELATED ART

In an electrophotographic image forming apparatus, an electrophotographic belt is used as a conveyance transfer belt configured to convey a transfer material or as an intermediate transfer belt configured to temporarily bear toner images for transfer. Toner which has not been transferred to the electrophotographic belt is cleaned by use of a cleaning member such as a cleaning blade formed of an elastic member such as urethane rubber. In recent years, in order to cope with other printing methods, there has been an increasing demand for higher durability of the electrophotographic image forming apparatus in viewpoint of reduction in cost, and there is a need for an electrophotographic belt which remains excellent in toner cleaning performance even when the number of printable sheets in service life increases.

In Japanese Patent Application Laid-Open No. 2013-044878, there is disclosed an electrophotographic image forming apparatus including a cleaning blade configured to remove adhering substances such as toner on an electrophotographic belt. Moreover, in Japanese Patent Application Laid-Open No. 2013-044878, it is disclosed that, in order to achieve stable removal of adhering substances such as toner, grooves which are inclined with respect to a moving direction of an electrophotographic belt are formed in the electrophotographic belt.

SUMMARY

One embodiment of the present disclosure is directed to providing an electrophotographic belt which is excellent in toner removal performance. Moreover, another embodiment of the present disclosure is directed to providing an electrophotographic image forming apparatus which is capable of sustainably forming high-quality electrophotographic images.

According to the one embodiment of the present disclosure, there is provided an electrophotographic belt having an endless shape, the electrophotographic belt having grooves on an outer surface of the electrophotographic belt, the grooves each extending in a circumferential direction, and being in non-parallel with the circumferential direction, the outer surface being composed only of: a first region in which the number of the grooves in a direction orthogonal to the circumferential direction is "n"; and a second region in which the number of the grooves in the direction orthogonal to the circumferential direction is larger than the "n", the first region and the second region being arranged alternately in the circumferential direction, and the "n" being an integer of 1 or more.

Moreover, according to the another embodiment of the present disclosure, there is provided an electrophotographic image forming apparatus comprising: an intermediate transfer belt; and a cleaning blade held in abutment against the intermediate transfer belt, wherein the intermediate transfer belt is the afore-mentioned electrophotographic belt.

Further features of the present disclosure will become apparent from the following description of exemplary embodiments with reference to the attached drawings.

DESCRIPTION OF THE EMBODIMENTS

According to further studies on Japanese Patent Application Laid-Open No. 2013-044878, we have found that, even when the electrophotographic belt having the grooves inclined with respect to the moving direction of the electrophotographic belt is used, the adhering substances such as toner become more liable to pass through the cleaning member along with increase in the number of printed sheets, which may result in degradation in quality of an electrophotographic image on a transfer material such as a sheet.

We have conducted studies on the electrophotographic belt according to Japanese Patent Application Laid-Open No. 2013-044878, specifically, as to the cause of the phenomenon in which the adhering substances such as toner become more liable to pass through the cleaning blade along with the increase in the number of printed sheets. When the grooves each extends in a circumferential direction of the electrophotographic belt, and is in non-parallel with the circumferential direction of the electrophotographic belt, an abutment position between the cleaning blade and the electrophotographic belt in the longitudinal direction of the cleaning blade changes, thereby being capable of preventing intensive wear at a certain part of the cleaning blade.

Figure 5:
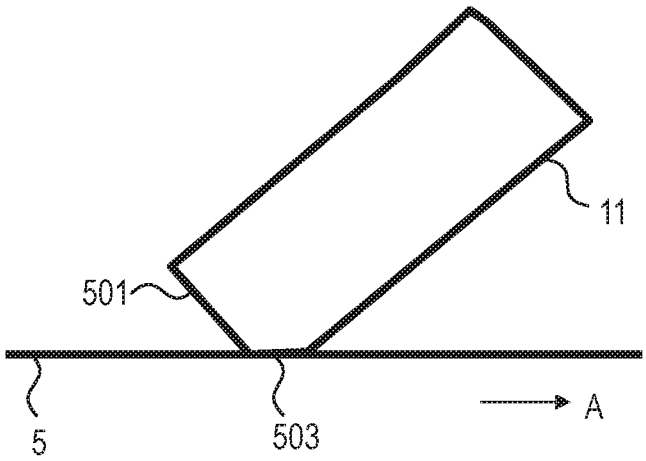
FIG. 5 is a schematic view for illustrating an abutment portion between the electrophotographic belt and a cleaning blade.

Meanwhile, when the abutment portion between the cleaning blade 11 and the electrophotographic belt 5 is viewed in a direction of a cross section of the cleaning blade 11, as illustrated in FIG. 5, a distal end 501 of the cleaning blade 11 is rolled up in a running direction of the electrophotographic belt 5 indicated by the arrow A, and is held in abutment against the surface of the electrophotographic belt 5 at an abutment portion 503. The position of the abutment portion 503 is always the same even when the grooves each extends in a circumferential direction of the electrophotographic belt, and is in non-parallel with the circumferential direction of the electrophotographic belt 5. It is assumed that such a configuration causes the electrophotographic belt 5 to be gradually worn along with the increase in the number of printed sheets, with the result that the adhering substances such as toner pass through the cleaning blade 11.

Therefore, we have conducted studies to achieve an object to provide an electrophotographic belt 5 which is capable of alleviating the wear at the abutment portion 503 between the cleaning blade 11 and the outer surface of the electrophotographic belt 5. As a result of the studies, we have found that the above-mentioned object can be well achieved with an electrophotographic belt 5 including an outer surface being composed only of: a first region in which the number of the grooves in a direction orthogonal to the circumferential direction of the electrophotographic belt 5 is "n"; and a second region in which the number of the grooves in the direction orthogonal to the circumferential direction of the electrophotographic belt 5 is larger than the "n". We have developed the following presumption as to the reason why the above-mentioned object can be well achieved with the electrophotographic belt 5 described above. Specifically, a frictional force generated between the cleaning blade 11 and the electrophotographic belt 5 changes at a boundary between the first region and the second region. Along with the change in frictional force, a position of the abutment portion 503 between the cleaning blade 11 and the electrophotographic belt 5 changes even slightly. It is presumed that such a phenomenon suppresses the wear at the abutment portion between the cleaning blade 11 and the electrophotographic belt 5.

<Electrophotographic Belt>

Now, detailed description is made of an electrophotographic belt having an endless shape according to one embodiment of the present disclosure. The present disclosure is not limited to the following embodiment.

Figure 1:
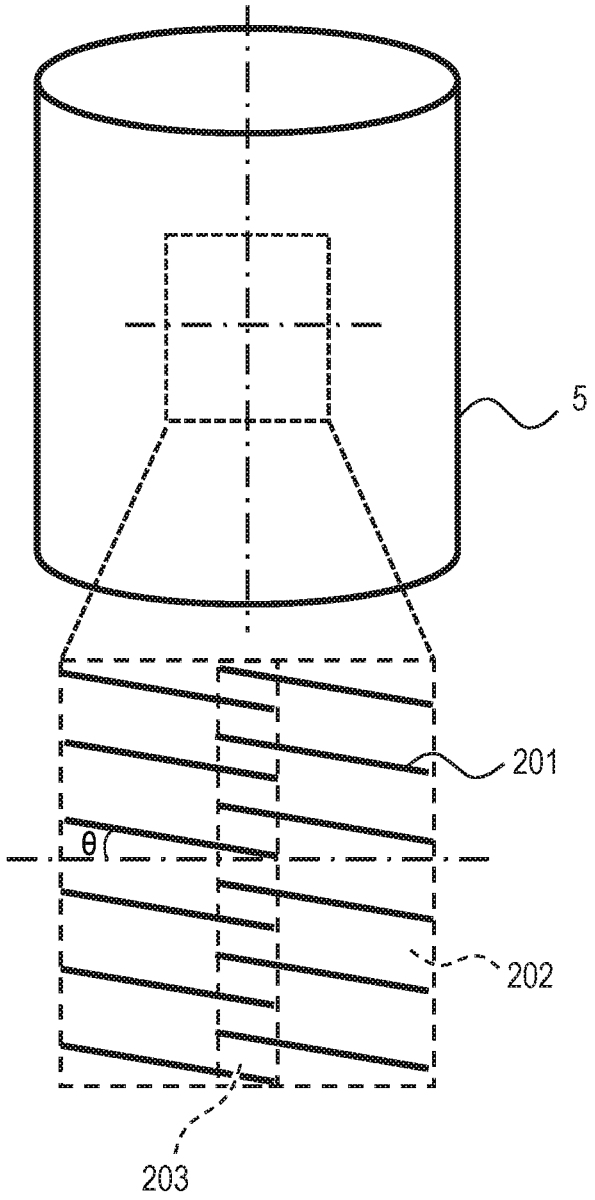
FIG. 1 is a schematic view for illustrating a configuration of a surface of an electrophotographic belt according to one embodiment of the present disclosure.

An outer circumferential surface of the electrophotographic belt according to this embodiment is schematically illustrated in FIG. 1. Grooves 201 are formed in a surface of an electrophotographic belt 5 on an outer circumferential side (hereinafter referred to also as "outer surface"). Each of the grooves 201 extends in a circumferential direction of the electrophotographic belt 5, and is non-parallel with the circumferential direction. Specifically, it is preferred that a value of a narrow angle θ formed by each of the grooves 201 with respect to the circumferential direction be larger than 0° and smaller than ±3°. It is more preferred that the value of the angle θ be smaller than ±1°. When the angle formed by each of the grooves 201 with respect to the circumferential direction is 0°, that is, when the grooves 201 extend in parallel with the circumferential direction of the electrophotographic belt, a part of the cleaning blade to be held in abutment against a region of the electrophotographic belt sandwiched between two adjacent grooves 201 is fixed, and only this part is worn. As a result, there is a risk of causing a toner removal defect.

Grooves are on an outer surface of the electrophotographic belt. The outer circumferential surface of the electrophotographic belt is composed only of a first region 202 and a second region 203. In the first region 202, the number of the grooves in a direction orthogonal to the circumferential direction is "n". In the second region 203, the number of the grooves in the direction orthogonal to the circumferential direction is larger than the "n". The first region and the second region are arranged alternately in the circumferential direction. The number "n" of the grooves 201 is an integer of 1 or more. The number "n" of the grooves 201 is not particularly limited as long as the toner removal can be stably performed. However, it is preferred that the number "n" of the grooves be from 2,000 to 120,000. When the number "n" is 2,000 or more, an area of a portion of the cleaning blade to be held in abutment against a portion having no groove 201 is reduced, thereby being capable of reducing a frictional force generated between the cleaning blade and the electrophotographic belt 5. When the number "n" is 120,000 or less, toner on the grooves 201 can be transferred more reliably.

It is preferred that the number of the grooves in the second region be 2n−10 or more and 2n+10 or less. When the number of the grooves in the second region is 2n−10 or more, a location of the abutment portion of the cleaning blade at the boundary between the first region and the second region can be stably changed. Moreover, when the number of the grooves in the second region is 2n+10 or less, toner on the grooves can be transferred more reliably.

With regard to all of the grooves, intervals of adjacent grooves are not particularly limited. However, it is preferred that the intervals of adjacent grooves be substantially uniform in view of toner removal performance. With the uniform intervals of the grooves, local wear of the blade can be suppressed.

It is preferred that the second region have a length of from 0.01 mm to 50 mm in the circumferential direction. Moreover, the grooves may each be non-continuous in the circumferential direction, and the second region may include end portions of the grooves. When the length of the second region in the circumferential direction is 50 mm or less, toner on the grooves can be transferred more reliably.

At least one second region is present on the outer surface of the electrophotographic belt 5. In particular, it is preferred that the number of the second region on the outer surface is one, two or three. It is more preferred that the number of the second region on the outer surface is two to three in the circumferential direction. When the number of the second region on the outer surface is two to three in the circumferential direction of the electrophotographic belt, toner on the grooves can be transferred more reliably.

It is preferred that the grooves 201 each have a depth of 0.10 μm or more and 5.0 μm or less. It is more preferred that the grooves 201 each have a depth of 0.20 μm or more and 2.0 μm or less. With the depth of each groove set within the ranges described above, a state of abutment of the cleaning blade against the electrophotographic belt can be stabilized for a long period of time.

It is preferred that the grooves each have a width of 0.10 μm or more and 3.0 μm or less. It is more preferred that the grooves each have a width of 0.20 μm or more and 2.0 μm or less. With the width of each groove set within the ranges described above, quality of an image on the electrophotographic belt can be maintained while maintaining toner transfer performance.

Examples of a processing method for forming the grooves may include well-known processing methods such as cutting, etching, and imprinting. In view of process reproducibility or processing cost for the grooves, it is preferred that the imprinting be adopted.

The electrophotographic belt may include only a base layer with the grooves on a surface of the base layer. Alternatively, the electrophotographic belt may include a base layer and a top surface layer in this order in the thickness direction of the electrophotographic belt. Further, the electrophotographic belt may include a base layer, an elastic layer and a top surface layer in this order in the thickness direction of the electrophotographic belt. In the case that the electrophotographic belt comprises the top surface layer, the top surface layer has the grooves on a surface thereof, that is not opposing to the base layer of the top surface layer, i.e. a surface constituting the outer surface of the electrophotographic belt. As a processing method for the base layer, there may be adopted a well-known processing method for thermoplastic resin or thermosetting resin.

As a processing method for thermoplastic resin, there may be adopted, for example, a well-known molding method such as a continuous melt-extrusion molding method, an injection molding method, a stretch blow molding method, an inflation molding method, and like with a pellet of a composition of thermoplastic resin or thermosetting resin, to thereby obtain the electrophotographic belt 5 having an endless shape. As a processing method for the top surface layer, there may be adopted a well-known molding method such as dip coating, spray coating, flow coating, shower coating, roll coating, spin coating, or ring coating, to thereby obtain the electrophotographic belt 5 having an endless shape.

The top surface layer may preferably comprise a cured product of an energy ray curable resin composition in order to have an excellent abrasion resistance. Examples of the energy ray may include ultraviolet ray, electron beam etc. Further, examples of the cured product of the energy ray curable resin may include an alkyd resin, an acrylic resin. Among them, a cured product of an acrylic resin having an unsaturated double bond is preferred from the view point of abrasion resistance.

The top surface layer may preferably contain particles containing fluorine containing resin in order to impart a sufficient slidability to the outer surface of the electroconductive belt. Examples of the fluorine containing resin include a polymer or copolymer derived from fluorine containing monomer such as tetrafluoroethylene, trifluorochloroethylene, tetrafluoroethylene hexafluoropropylene, vinyl fluoride, vinylidene fluoride, and difluorodichloroethylene. Among them, polytetrafluoroethylene (PTFE) particles may preferably be used since the surfaces of the PTFE particles have a low friction coefficient. Thus, in the case that the top surface layer contains PTFE particles, the friction between the outer surface of the electrophotographic belt and the cleaning blade can more effectively reduced. The particles may have an average primary particle diameter of from 0.2 μm to 0.6 μm. The diameter in the range suppresses the aggregation of the particles in a coating liquid for forming the top surface layer.

It is preferred that the electrophotographic belt 5 have a thickness of 10 μm or more and 500 μm or less, more preferably, 30 μm or more and 150 μm or less. Moreover, the electrophotographic belt 5 according to the present disclosure may be used as a belt, or may be used by being wound or covered on a drum or a roll used as an electrophotographic member.

<Electrophotographic Image Forming Apparatus>

Now, detailed description is made of an electrophotographic image forming apparatus according to one embodiment of the present disclosure. The present disclosure is not limited to the following embodiment.

Figure 2:
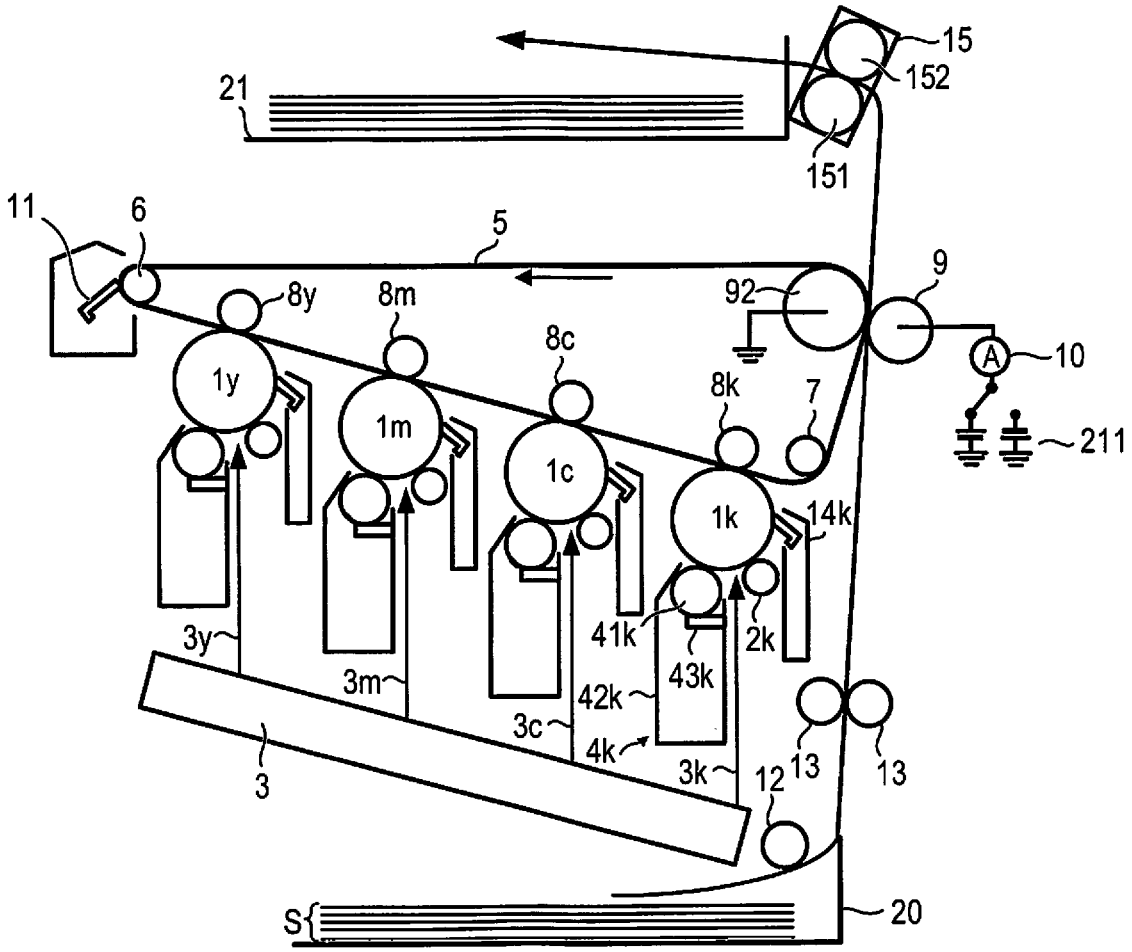
FIG. 2 is a schematic view for illustrating an example of a configuration of an electrophotographic image forming apparatus of an intermediate transfer type.

FIG. 2 is an illustration of an electrophotographic image forming apparatus including the electrophotographic belt 5 according to one embodiment of the present disclosure as an intermediate transfer belt, and is an illustration of an example of an electrophotographic image forming apparatus having a configuration of an electrophotographic apparatus. The electrophotographic image forming apparatus is configured to form a color image through use of toners of four colors represented by C (cyan), M (magenta), Y (yellow), and K (black) on a recording medium S such as a sheet fed from a sheet-feeding cassette 20, and image forming stations for respective colors are arrayed in a substantially horizontal direction. The image forming stations include photosensitive drums 1*c*, 1*m*, 1*y*, and 1*k*, respectively. Herein, the suffixes "c", "m", "y", and "k" are added to the reference symbols to indicate which of the image forming stations for respective colors include the members denoted by the reference symbols. The electrophotographic image forming apparatus includes a laser scanner 3 being a laser optical unit, and laser beams 3*c*, 3*m*, 3*y*, and 3*k* are emitted from the laser scanner 3 in accordance with image signals for respective colors to irradiate the photosensitive drums 1*c*, 1*m*, 1*y*, and 1*k*, respectively. The image forming stations have the same structure. Therefore, the image forming station for the color K is described. A conductive roller 2*k* being a contact charging device, a developing device 4*k*, a primary transfer roller 8*k* being a conductive roller, and a toner collection blade 14*k* to be used for cleaning the photosensitive drum 1*k* are arranged so as to surround the photosensitive drum 1*k*. In the developing device 4*k*, there are provided a developing roller 41*k*, a developer container 42*k*, and a developing blade 43*k*. The developing roller 41*k* is a developer bearing member configured to develop a latent image formed on the photosensitive drum 1*k*. The developer container 42*k* is configured to hold toner to be supplied to the developing roller 41*k*. The developing blade 43*k* is configured to regulate the amount of toner on the developing roller 41*k* and apply an electric charge.

The electrophotographic belt 5 is formed as a belt having an endless shape, and is provided for the image forming stations for respective colors in common. The electrophotographic belt 5 is stretched around a secondary transfer opposing roller 92, a tension roller 6, and a drive roller 7, and is rotated by the drive roller 7 in the direction indicated by the arrow in FIG. 2. In a section between the tension roller 6 and the drive roller 7, the electrophotographic belt 5 is sequentially held in abutment against surfaces of the photosensitive drums 1*y*, 1*m*, 1*c*, and 1*k*, and are pressurized by primary transfer rollers 8*y*, 8*m*, 8*c*, and 8*k* toward the photosensitive drums 1*y*, 1*m*, 1*c*, and 1*k* side, respectively.

With such a configuration, toner images formed on the surfaces of the photosensitive drums 1*y*, 1*m*, 1*c*, and 1*k* are transferred onto an outer surface of the electrophotographic belt 5 being the intermediate transfer belt. A secondary transfer roller 9 is provided so as to be opposed to the secondary transfer opposing roller 92, and the electrophotographic belt 5 is pressurized by the secondary transfer roller 9 toward the secondary transfer opposing roller 92 side. A secondary transfer voltage is applied to the secondary transfer roller 9 from a power supply 211 through intermediation of a current detection circuit 10. The secondary transfer roller 9 and the secondary transfer opposing roller 92 form a secondary transfer portion. The recording medium S is fed and conveyed by a feed roller 12 and conveyance rollers 13, and passes through a nip portion defined between the electrophotographic belt 5 and the secondary transfer roller 9 at the position of the secondary transfer opposing roller 92. Thus, the toner images borne on the outer circumferential surface of the electrophotographic belt 5 is transferred onto the recording medium S. With those actions, an image is formed on a surface of the recording medium S. The recording medium S having the toner images transferred thereonto passes through a fixing device 15 formed of a roller pair consisting of a heating roller 151 and a pressurizing roller 152. Thus, the image is fixed on the recording medium S, and the recording medium S is delivered to a sheet delivery tray 21. At the position of the tension roller 6, there is provided a cleaning blade 11 which is held in abutment against the outer circumferential surface of the electrophotographic belt 5. Toner which remains on the outer circumferential surface of the electrophotographic belt 5 without having been transferred onto the recording medium S is scraped off and removed by the cleaning blade 11. The cleaning blade 11 is a member which extends in a direction which is substantially orthogonal to a moving direction of the electrophotographic belt 5.

The cleaning blade 11 is not particularly limited as long as it is suitable for toner removal, and may be, for example, urethane rubber, acryl rubber, nitrile rubber, or EPDM rubber. In view of the toner removal performance, the urethane rubber is preferred.

According to one embodiment of the present disclosure, an electrophotographic belt which has an endless shape and is sustainably excellent in toner removal performance can be obtained. Moreover, according to another embodiment of the present disclosure, an electrophotographic image forming apparatus which is capable of sustainably forming high-quality electrophotographic images can be obtained.

EXAMPLES

Now, the present disclosure is specifically described with examples and comparative examples, but the present disclosure is not limited to those examples. Methods of evaluation in terms of characteristic values and performance for electrophotographic belts produced in the examples and the comparative examples include [Evaluation 1] to [Evaluation 4] described below.

[Evaluation 1]

Evaluation of Number of Grooves and Length of Second Region in Outer Surface of Electrophotographic Belt A state of grooves on an outer surface of an electrophotographic belt was observed over an entire surface of the belt through use of a digital microscope (trade name: VHX-500, manufactured by Keyence Corporation) with a magnification of 10. The presence or absence and the number of the first region and the second region were checked, and the length was also checked for the second region. Next, the number of grooves in the direction orthogonal to the circumferential direction was counted for each of the first region and the second region. With regard to a location of counting the number of grooves, when the region had a length of 100 mm or less, the number was counted at one point in the center of the region. When the region had a length of longer than 100 mm, one-point measurement was performed for every 100 mm, and an average value thereof was calculated.

[Evaluation 2]

Evaluation of Angle of Grooves with respect to Circumferential Direction of Outer Surface of Electrophotographic Belt With regard to a state of the grooves on the outer surface of the electrophotographic belt, through use of the digital microscope (trade name: VHX-500, manufactured by Keyence Corporation) with a magnification of 10, the amount of deviation of the grooves inclined with respect to the circumferential direction of the belt was read, and an angle of the grooves with respect to the circumferential direction was determined through calculation based on the amount of deviation.

[Evaluation 3]

Evaluation of Toner Removal Performance

An electrophotographic image forming apparatus having the configuration illustrated in FIG. 2 (trade name: LBP712Ci, manufactured by Canon Inc. and modified through removal of a charged brush for toner collection) was used. An intermediate transfer belt as the electrophotographic belt 5 was mounted, and cleaning with the blade was performed while printing images. In such a state, evaluation of the toner removal performance was performed. This evaluation was performed with the following conditions. Under the environment with a temperature of 15° C. and a relative humidity of 10%, sheets of Extra manufactured by Canon Inc. (basis weight of 80 g/m2) having the JIS A4 size were used as the recording medium S, and passage of sheets was performed with an upper limit of 200,000 sheets until a toner removal defect occurs in 2-sheet intermittent printing. Then, the evaluation was performed based on whether or not toner passed through the cleaning blade.

Specifically, a red image (Y toner and M toner) having a size corresponding to an entire surface of the A4 size sheet was formed on the electrophotographic belt by the primary transfer, and thereafter a secondary transfer bias was turned off (0 V). On this occasion, the images of the Y toner and the M toner formed on the electrophotographic belt were scarcely transferred onto the recording medium S, and proceeded to the cleaning blade while remaining on the electrophotographic belt. After that, the secondary transfer bias was set to an appropriate value, and three sheets were successively allowed to pass under a state of being white. When toner was removed from the electrophotographic belt by the cleaning blade, three sheets subsequently passing through the cleaning blade were output under a state of being completely white. Meanwhile, when toner was not removed from the electrophotographic belt, toner having passed through the cleaning blade was transferred onto white paper, and an image having a toner removal defect was output. When the image having the toner removal defect was output, it was judged that the toner removal defect occurred. The evaluation described above was performed at each of the timing after passage of 100,000 sheets, the timing after passage of 150,000 sheets, the timing after passage of 180,000 sheets, and the timing after passage of 200,000 sheets. Then, based on the results of evaluations, the electrophotographic belt was ranked with the following criteria.

Rank A: The toner removal defect did not occur in the course of passage of 200,000 sheets.

Rank B: The toner removal defect occurred in the course of passage of 200,000 sheets.

Rank C: The toner removal defect occurred in the course of passage of 180,000 sheets.

Rank D: The toner removal defect occurred in the course of passage of 150,000 sheets.

Rank E: The toner removal defect occurred in the course of passage of 100,000 sheets.

[Evaluation 4]

Evaluation of Halftone Image Performance

An electrophotographic image forming apparatus having the configuration illustrated in FIG. 2 (trade name: LBP712Ci, manufactured by Canon Inc. and modified through removal of a charged brush for toner collection) was used. An intermediate transfer belt as the electrophotographic belt 5 was mounted, and a halftone red image (Y toner and M toner) was output. Based on the results of evaluations, the electrophotographic belt was ranked with the following criteria.

Rank A: Streak-like density unevenness was not seen.

Rank B: Streak-like density unevenness was slightly seen.

Rank C: Streak-like density unevenness was seen.

Example 1

[Manufacture of Base Layer]

First, through use of a twin screw extruder (trade name: TEX30a, manufactured by The Japan Steel Works, LTD.), materials for formation of the base layer, which are shown in Table 1, were thermally melted and kneaded with a ratio of polyethylene naphthalate/polyether ester amide/carbon black=84/15/1 (mass ratio) shown in Table 1, to thereby prepare a thermoplastic resin composition. The thermal melting and kneading temperature was adjusted so as to fall within the range of 260° C. or more to 280° C. or less, and the thermal melting and kneading time was set to about 3 to 5 minutes. The obtained thermoplastic resin composition was pelleted and dried at a temperature of 140° C. for 6 hours.

TABLE 1

| Material | Blending amount (part(s) by mass) |
|---|---|
| Polyethylene naphthalate (trade name: TN-8050SC, manufactured by Teijin Chemicals Ltd.) | 84 |
| Polyether ester amide (trade name: PELESTAT NC6321, manufactured by Sanyo Chemical Industries, Ltd.) | 15 |
| Carbon black (trade name: MA-100, manufactured by Mitsubishi Chemical Corporation) | 1 |

Then, the dried pellet-shaped thermoplastic resin composition was supplied to an injection molding machine (trade name: SE180D, manufactured by Sumitomo Heavy Industries, Ltd.). Then, the thermoplastic resin composition was subjected to injection molding with a mold adjusted to a temperature of 30° C., with a cylinder setting temperature being 295° C., to obtain a preform. The obtained preform has a test tube shape having an outer diameter of 50 mm, an inner diameter of 46 mm, and a length of 100 mm.

Figure 3:
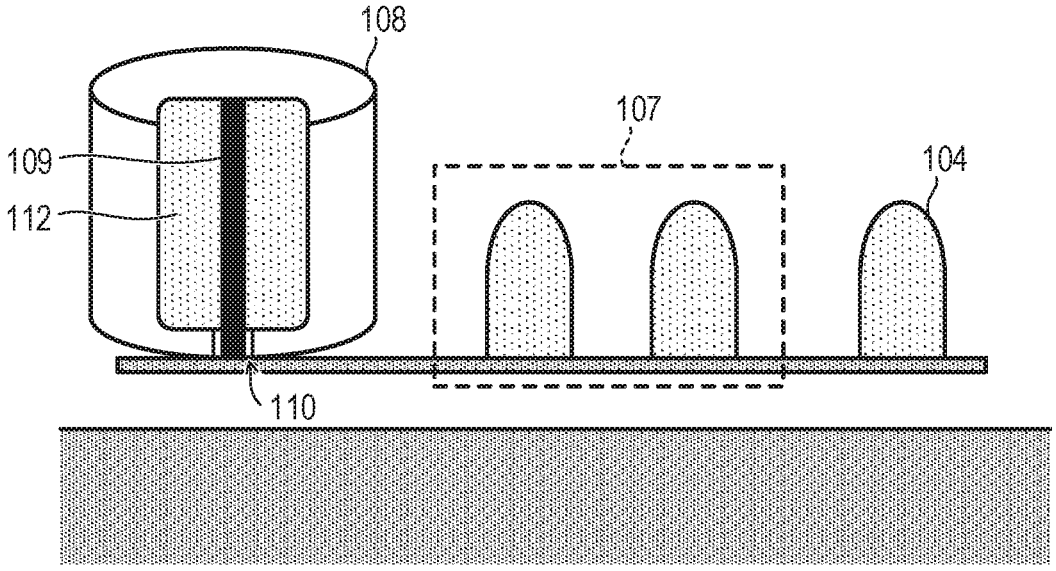
FIG. 3 is a schematic view for illustrating an example of a method of manufacturing the electrophotographic belt through use of a stretch blow molding machine.

Next, the above-mentioned preform is biaxially stretched through use of a biaxial stretching machine (stretch blow molding machine) illustrated in FIG. 3. Before biaxial stretching, a preform 104 was placed in a heating device 107 equipped with a non-contact type heater (not shown) for heating an outer wall and an inner wall of the preform 104 and was heated with the heating heater so that an outer surface temperature of the preform reached 150° C.

Then, the heated preform 104 was placed in a blow mold 108 with a mold temperature being kept at 30° C. and stretched in an axial direction through use of a stretching rod 109. Concurrently, air adjusted to a temperature of 23° C. was introduced into the preform from a blow air injection portion 110 to stretch the preform 104 in a radial direction. Thus, a bottle-shaped molded product 112 was obtained.

Next, a barrel portion of the obtained bottle-shaped molded product 112 was cut, to thereby obtain a base layer of an electrophotographic belt having a seamless and endless shape. The base layer of the electrophotographic belt had a thickness of 70.2 μm, a circumferential length of 712.2 mm, and a width of 244.0 mm.

[Formation of Top Surface Layer]

Materials for formation of the top surface layer, which are shown in Table 2, were mixed at a blend ratio (mass ratio in terms of solid content) shown in Table 2, to thereby obtain coating liquid for formation of the top surface layer. Specifically, a solution having been subjected to rough dispersion processing for materials excluding SL was subjected to dispersion through use of a high-pressure emulsification/dispersion machine (trade name: Nanovator, manufactured by YOSHIDA KIKAI CO., LTD.). This dispersion processing was performed until a 50% average particle size of the contained PTFE became 200 nm. While SL was further stirred, liquid of the PTFE having been subjected to this dispersion processing was dropped, to thereby obtain the coating liquid for formation of the top surface layer. The particle size of the PTFE in the coating liquid was measured based on a dynamic light scattering (DLS) technology (ISO-D1522412 standard) through use of a thick system particle size analyzer (trade name: FPAR-1000, manufactured by OTSUKA ELECTRONICS CO., LTD).

TABLE 2

| Material for formation of top surface layer | Abbreviation | Blending amount (part(s) by mass) |
|---|---|---|
| Dipentaerythritol pentaacrylate and dipentaerythritol hexaacrylate (trade name: ARONIX M-402, manufactured by Toagosei Co., Ltd.) | AN | 60.0 |
| Polytetrafluoroethylene particles (trade name: Lubron L-2, manufactured by Daikin Industries, Ltd.,) * average primary particle diameter: 0.3 μm | PTFE | 20.0 |
| PTFE particle dispersant (trade name: GF-300, manufactured by Toagosei Co., Ltd.) | GF | 1.0 |
| Zinc antimonate particle slurry (trade name: CELNAX CX-Z400K, manufactured by Nissan Chemical Corporation, 40 mass % of zinc antimonate particle component) | SL | 12.0 |
| Photopolymerization initiator (trade name: Irgacure 907, manufactured by BASF) | IRG | 1.0 |

The base layer obtained through blow molding was fitted to an outer periphery of a cylindrical mold, and end portions thereof were sealed. Then, the base layer and the mold were soaked together in a container filled with the coating liquid for formation of the top surface layer, and were drawn upward such that a liquid surface of the curable composition and the base layer move at a constant relative speed, thereby forming a coating film, which was formed of the coating liquid for formation of the top surface layer, on the base layer surface. The drawing speed (relative speed between the liquid surface of the curable composition and the base layer) and a solvent ratio of the curable composition can be adjusted in accordance with a required film thickness. In this example, adjustment was made so as to have the drawing speed of from 10 mm/sec to 50 mm/sec and the film thickness of 3 μm for the top surface layer. After the formation of the coating film, the coating film was dried under the 23° C. environment with the reduced pressure for one minute. The drying temperature and the drying time may suitably be adjusted based on a kind of solvent, a solvent ratio, and a film thickness. After that, the coating film was irradiated with ultraviolet rays through use of a UV irradiator (trade name: UE06/81-3, manufactured by EYE GRAPHICS Co., Ltd.) until the integrated light quantity reached 600 mJ/cm$^2$, to thereby cure the coating film and form the top surface layer on the outer circumferential surface of the base layer. The thickness of the top surface layer was 3.0 which was measured by observation of a cross section through use of an electron microscope (trade name: XL30-SFEG, manufactured by FEI Company).

[Formation of Grooves in Outer Surface of Electrophotographic Belt]

Figure 4:
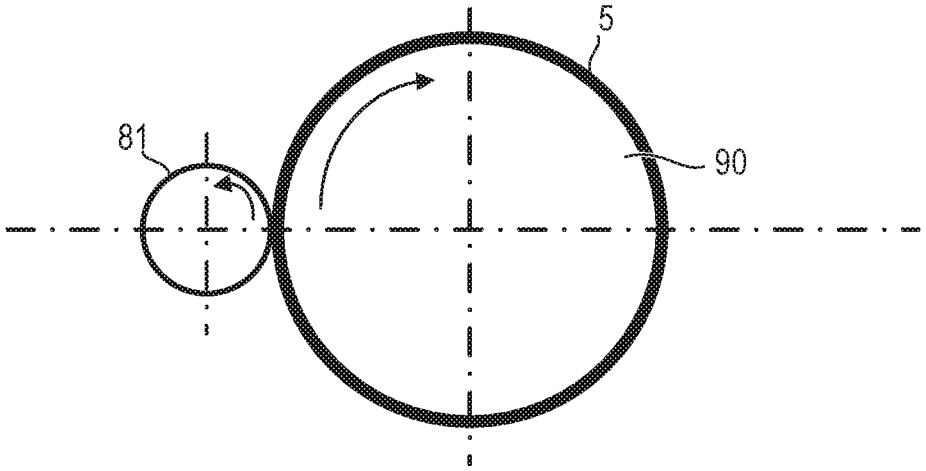
FIG. 4 is a schematic view for illustrating a configuration of an imprinting apparatus configured to form grooves in the surface of the electrophotographic belt.

Through use of an imprinting apparatus illustrated in FIG. 4, grooves were formed in the outer surface of the top surface layer. A die having the following configuration was prepared as a groove-forming cylindrical die 81. Through cutting, a projection pattern having a diameter of 50 mm, a length of 250 mm, a projection height of 3.5 a projection bottom length of 2.0 a projection top length of 0.2 and a projection pattern interval of 20 μm was continuously formed in a spiral shape. The projection pattern of the groove-forming cylindrical die 81 had an angle of 0.1° with respect to the circumferential direction. The groove-forming cylindrical die 81 was formed of carbon steel (S45C) having electroless nickel coating applied thereto. A cartridge heater is provided in the groove-forming cylindrical die 81 so that heating can be performed.

The base layer having the top surface layer formed on the outer circumferential surface thereof was fitted to an outer periphery of a holder 90 (having a circumferential length of 712 mm). Both the groove-forming cylindrical die 81 and the holder 90 can rotate on their own axes, respectively. Both the groove-forming cylindrical die 81 and the holder 90 were rotated on their own axes in opposite directions at a speed of 30 mm/sec, and respective axial center lines were maintained parallel with each other. In this state, the groove-forming cylindrical die 81 having been heated to 130° C. was pressed against the holder 90 with a pressing force of 8.0 MPa. Through this method, the projection pattern of the groove-forming cylindrical die 81 was transferred onto the outer surface of the top surface layer, thereby forming the electrophotographic belt 5 having the grooves on the outer surface thereof. After the holder 90 was rotated slightly over (about 1 mm) one rotation, the groove-forming cylindrical die 81 was separated. The projection pattern of the groove-forming cylindrical die 81 had a spiral shape. Therefore, the starting end and the terminating end of the grooves were not connected to each other after the one rotation, and hence the second region in which the number of grooves was larger than the number "n" of grooves of the first region was formed.

The obtained pattern of grooves on the electrophotographic belt 5 included one first region and one second region, with 12,200 grooves in the first region, 24,401 grooves in the second region, a length of the second region being 1.1 mm, and an angle of each of the grooves being 0.1° with respect to the circumferential direction.

The electrophotographic belt 5 obtained in such a manner was mounted as an intermediate transfer belt to the electrophotographic image forming apparatus illustrated in FIG. 2, and evaluation of the toner removal performance was performed. No toner removal defect occurred in the course of passage of 200,000 sheets, and it was determined that the electrophotographic belt was in the rank A.

The electrophotographic belt 5 described above was mounted as an intermediate transfer belt to the electrophotographic image forming apparatus illustrated in FIG. 2, and evaluation of the halftone image performance was performed. The streak-like density unevenness which might be caused by the groove pattern of the surface of the electrophotographic belt 5 was not seen, and it was determined that the electrophotographic belt was in the rank A.

Examples 2 to 4

Electrophotographic belts were prepared in the same manner as that of Example 1 except that the intervals of the projection patterns of the groove-forming cylindrical dies were set to 100 μm, 2.2 μm, and 1.8 μm, respectively, and then evaluations were performed.

Example 5

The groove-forming cylindrical die was pressed against the cylindrical belt holder by half rotation. After that, the groove-forming cylindrical die was separated, and then was slid by 10 μm in an axial direction of the cylindrical belt holder. Further, the cylindrical belt holder was reversely rotated by a circumferential length of 1 mm. In this state, the groove-forming cylindrical die was pressed against the cylindrical belt holder by half rotation again, and then the groove-forming cylindrical die was separated. The electrophotographic belt was prepared in the same manner as that of Example 1 except for the operations described above, and evaluation was performed.

Example 6

The groove-forming cylindrical die was pressed against the cylindrical belt holder by one-third rotation. After that, the groove-forming cylindrical die was separated, and then was slid by 10 μm in the axial direction of the cylindrical belt holder. Further, the cylindrical belt holder was reversely rotated by a circumferential length of 1 mm. In this state, the groove-forming cylindrical die was pressed against the cylindrical belt holder by one-third rotation again. After that, the groove-forming cylindrical die was separated, and then was slid by 10 μm in the axial direction of the cylindrical belt holder. Further, the cylindrical belt holder was reversely rotated by a circumferential length of 1 mm. Then, the groove-forming cylindrical die was pressed against the cylindrical belt holder by one-third rotation, and the groove-forming cylindrical die was separated. The electrophotographic belt was prepared in the same manner as that of Example 1 except for the operations described above, and evaluation was performed.

Example 7

The groove-forming cylindrical die was pressed against the cylindrical belt holder by one-fourth rotation. After that, the groove-forming cylindrical die was separated, and then was slid by 10 μm in the axial direction of the cylindrical belt holder. Further, the cylindrical belt holder was reversely rotated by a circumferential length of 1 mm. The operation described above was repeated three times. After that, the groove-forming cylindrical die was pressed against the cylindrical belt holder by one-fourth rotation, and then the groove-forming cylindrical die was separated. The electrophotographic belt was prepared in the same manner as that of Example 1 except for the series of operations described above, and evaluation was performed.

Example 8

The groove-forming cylindrical die was pressed against the cylindrical belt holder by just one rotation. After that, the groove-forming cylindrical die was separated. The electrophotographic belt was prepared in the same manner as that of Example 1 except for the operations described above, and evaluation was performed. In the electrophotographic belt of Example 8, end portions of the grooves were present on a straight line having a thickness of 0.01 mm and extending in the direction orthogonal to the circumferential direction. Thus, the second region having a length of 0.01 mm in the circumferential direction was present.

Examples 9 to 11

Electrophotographic belts were prepared in the same manner as that of Example 1 except that the lengths of the second regions were set to 0.02 mm, 49 mm, and 65 mm, respectively, and evaluations were performed.

Examples 12 to 14

Electrophotographic belts were prepared in the same manner as that of Example 1 except that, in the course of continuously forming the projection pattern having the spiral shape by the groove-forming cylindrical die, the angles of the projection patterns of the groove-forming cylindrical die with respect to the circumferential direction were set to 0.01°, 0.9°, and 3.0°, respectively, and evaluations were performed.

Comparative Example 1

An electrophotographic belt was prepared in the same manner as that of Example 1 except that the angle of the projection pattern of the groove-forming cylindrical die with respect to the circumferential direction was set to 0°, and evaluation was performed.

Comparative Examples 2 and 3

Electrophotographic belts of Comparative Example 2 and Comparative Example 3 were prepared in the same manner as that of Example 2 or Example 3 except that the angle of the projection pattern of the groove-forming cylindrical die with respect to the circumferential direction was set to 0°, and evaluations were performed.

Comparative Example 4

An electrophotographic belt of Comparative Example 4 was prepared in the same manner as that of Example 1 except that the angle of the projection pattern of the groove-forming cylindrical die with respect to the circumferential direction was set to 0° and that processing was performed with a deviation of an axial center line of the groove-forming cylindrical die by 0.1° with respect to an axial center line of the cylindrical belt holder, and evaluation was performed.

Evaluation results for the electrophotographic belts of Examples 1 to 14 are shown in Table 3. Moreover, evaluation results for the electrophotographic belts of Comparative Examples 1 to 4 are shown in Table 4.

TABLE 3

| | Example | | | | | | | |
|---|---|---|---|---|---|---|---|---|
| | 1 | 2 | 3 | 4 | 5 | 6 | 7 | 8 |
| Number of grooves in first region | 12200 | 2440 | 110910 | 135560 | 12200 | 12200 | 12200 | 12200 |
| Number of second region | 1 | 1 | 1 | 1 | 2 | 3 | 4 | 1 |
| Length of second region (mm) | 1.1 | 1.1 | 1.1 | 1.1 | 1.0<br>1.1 | 1.0<br>1.0<br>1.1 | 1.1<br>1.0<br>1.1<br>1.1 | 0.01 |
| Number of grooves in second region | 24401 | 4881 | 221820 | 271111 | 24401 | 24401 | 24401 | 24401 |
| Angle of grooves with respect to circumferential direction (°) | 0.1 | 0.1 | 0.1 | 0.1 | 0.1 | 0.1 | 0.1 | 0.1 |
| Toner removal performance | A | A | A | A | A | A | B | B |
| Halftone image performance | A | A | A | B | A | B | B | A |

| | Example | | | | | |
|---|---|---|---|---|---|---|
| | 9 | 10 | 11 | 12 | 13 | 14 |
| Number of grooves in first region | 12200 | 12200 | 13000 | 12200 | 12200 | 12200 |
| Number of second region | 1 | 1 | 1 | 1 | 1 | 1 |
| Length of second region (mm) | 0.02 | 49 | 65 | 1.1 | 1.1 | 1.1 |
| Number of grooves in second region | 24401 | 24401 | 24401 | 24401 | 24401 | 24401 |

TABLE 3-continued

| | | | | | | |
|---|---|---|---|---|---|---|
| Angle of grooves with respect to circumferential direction (°) | 0.1 | 0.1 | 0.1 | 0.01 | 0.9 | 3.0 |
| Toner removal performance | A | A | B | A | A | B |
| Halftone image performance | A | B | B | A | A | A |

TABLE 4

| | Comparative Example | | | |
|---|---|---|---|---|
| | 1 | 2 | 3 | 4 |
| Number of grooves in first region | 12200 | 2440 | 110910 | 12200 |
| Number of second region | 0 | 0 | 0 | 0 |
| Length of second region (mm) | — | — | — | — |
| Number of grooves in second region | — | — | — | — |
| Angle of grooves with respect to circumferential direction (°) | 0 | 0 | 0 | 0.1 |
| Toner removal performance | D | E | C | C |
| Halftone image performance | A | A | A | A |

[Results and Discussion]

As shown in Table 3, in Examples 1 to 7 and 9 to 14, the second region in which the number of grooves is larger than that in the first region is present. Therefore, the mechanism mentioned above suppressed the amount of wear of the cleaning blade, and hence the toner removal performance was excellent.

In Example 8, each of the grooves is non-continuous in the circumferential direction, and the second region is formed at an end portion of each groove. The second region formed of the end portions of the grooves was present. Therefore, the mechanism mentioned above suppressed the amount of wear of the cleaning blade, and hence the toner removal performance was excellent.

Meanwhile, as shown in Table 4, in Comparative Examples 1 to 4, no second region is present. Therefore, the mechanism mentioned above caused local wear in the cleaning blade. Thus, the toner removal performance was inferior.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-080941, filed Apr. 19, 2018, and Japanese Patent Application No. 2019-049878, filed Mar. 18, 2019, which are hereby incorporated by reference herein in their entirety.

What is claimed is:

1. An electrophotographic belt having an endless shape, the electrophotographic belt having grooves on an outer surface of the electrophotographic belt, the grooves each extending in a circumferential direction of the electrophotographic belt, and being non-parallel with the circumferential direction of the electrophotographic belt, the outer surface being composed only of (i) a first region in which a number of the grooves in a direction orthogonal to the circumferential direction of the electrophotographic belt is n and (ii) a second region in which a number of the grooves in the direction orthogonal to the circumferential direction of the electrophotographic belt is larger than n, wherein the first region and the second region are arranged alternately in the circumferential direction of the electrophotographic belt, and n is an integer of 1 or more.

2. The electrophotographic belt according to claim 1, wherein n is 2,000 to 120,000.

3. The electrophotographic belt according to claim 2, wherein the number of the grooves in the second region is 2n−10 to 2n+10.

4. The electrophotographic belt according to claim 1, wherein the second region has a length of from 0.01 to 50 mm in the circumferential direction of the electrophotographic belt.

5. The electrophotographic belt according to claim 1, wherein a number of the second region on the outer surface is at least one.

6. The electrophotographic belt according to claim 5, wherein the number of the second region on the outer surface is one, two or three.

7. The electrophotographic belt according to claim 1, wherein each of the grooves is non-continuous in the circumferential direction of the electrophotographic belt, and the second region includes end portions of the grooves.

8. The electrophotographic belt according to claim 1, wherein a narrow angle formed by each of the grooves with respect to the circumferential direction of the electrophotographic belt is larger than 0° and smaller than 1°.

9. The electrophotographic belt according to claim 1, comprising a base layer and a top surface layer in this order in a thickness direction of the electrophotographic belt, wherein the top surface layer has the grooves on a surface not opposing the base layer of the top surface layer.

10. The electrophotographic belt according to claim 9, wherein the top surface layer contains a cured product of an energy curable resin composition.

11. The electrophotographic belt according to claim 9, wherein the top surface layer contains an acrylic resin.

12. The electrophotographic belt according to claim 9, wherein the top surface layer further contains particles containing a fluorine containing resin.

13. The electrophotographic belt according to claim 12, wherein the fluorine containing resin is polytetrafluoroethylene.

14. An electrophotographic image forming apparatus comprising:

an intermediate transfer belt; and a cleaning blade held in abutment against the intermediate transfer belt, wherein the intermediate transfer belt is an electrophotographic belt having an endless shape, the electrophotographic belt having grooves on an outer surface of the electrophotographic belt, the grooves each extending in a circumferential direction of the electrophotographic belt, and being non-parallel with the circumferential direction of the electrophotographic belt, the outer surface being composed only of (i) a first region in which a number of the grooves in a direction orthogonal to the circumferential direction of the electrophotographic belt is n; and (ii) a second region in which a number of the grooves in the direction orthogonal to the circumferential direction of the electrophotographic belt is larger than n, wherein the first region and the second region are arranged alternately in the circumferential direction of the electrophotographic belt, and n is an integer of 1 or more.

15. The electrophotographic image forming apparatus according to claim 14, wherein the cleaning blade comprises urethane rubber.

* * * * *